US011490474B1

(12) United States Patent
Lax et al.

(10) Patent No.: US 11,490,474 B1
(45) Date of Patent: Nov. 1, 2022

(54) BI-LEVEL LIGHT FIXTURE FOR PUBLIC TRANSPORTATION TUNNELS

(71) Applicant: Autronic Plastics, Inc., Central Islip, NY (US)

(72) Inventors: Daniel A. Lax, Roslyn, NY (US); Agjah I. Libohova, East Setauket, NY (US)

(73) Assignee: Autronic Plastics, Inc., Central Islip, NY (US)

( * ) Notice: Subject to any disclaimer, the term of this patent is extended or adjusted under 35 U.S.C. 154(b) by 0 days.

(21) Appl. No.: 16/835,164

(22) Filed: Mar. 30, 2020

Related U.S. Application Data

(60) Provisional application No. 62/985,268, filed on Mar. 4, 2020, provisional application No. 62/826,509, filed on Mar. 29, 2019.

(51) Int. Cl.

| | |
|---|---|
| ***H05B 45/10*** | (2020.01) |
| ***F21S 8/00*** | (2006.01) |
| ***H05B 47/17*** | (2020.01) |
| ***F21V 23/04*** | (2006.01) |
| ***H05B 47/16*** | (2020.01) |

(Continued)

(52) U.S. Cl.
CPC ..... *H05B 45/10* (2020.01); *F21S 8/036* (2013.01); *F21V 23/04* (2013.01); *H05B 47/16* (2020.01); *H05B 47/17* (2020.01); *F21W 2131/101* (2013.01); *F21Y 2115/10* (2016.08)

(58) Field of Classification Search
CPC ... F21S 8/036; F21V 23/04; F21W 2131/101; F21Y 2115/10
See application file for complete search history.

(56) References Cited

U.S. PATENT DOCUMENTS

| | | | |
|---|---|---|---|
| 2,463,046 | A | 9/1945 | Naysmith |
| 2,527,216 | A | 4/1947 | Harris |
| 2,673,286 | A | 3/1954 | Moore |

(Continued)

FOREIGN PATENT DOCUMENTS

| | | | |
|---|---|---|---|
| KR | 1487340 | B1 | 2/2015 |
| WO | 2007030542 | A2 | 3/2007 |
| WO | 2014134608 | A2 | 9/2014 |

OTHER PUBLICATIONS

Philips Lumileds Press Information, Jan. 23, 2007.

(Continued)

*Primary Examiner* — Jany Richardson
(74) *Attorney, Agent, or Firm* — Fred Zollinger

(57) ABSTRACT

A light fixture usable in train tunnels provides normal mode downlighting for track and walkway lighting and a selective task lighting mode where higher-lumen lighting is provided in at least the same downlighting direction as the track and walkway lighting. The normal lighting illumination level is at least 0.25 to 2.00 foot-candles at the illuminated surfaces. The task lighting mode provides at least 5.00 foot-candles to the same illuminated surfaces. The task lighting mode is achieved with the same light source that provides the normal mode lighting or with additional light sources that are activated together with or instead of the normal lighting mode light sources. The light sources can be a plurality light emitting diode (LED) engines that include a plurality of LEDs. The task lighting mode can also use another light source to provide additional task lighting up from the fixture.

20 Claims, 12 Drawing Sheets

(51) Int. Cl.
*F21Y 115/10* (2016.01)
*F21W 131/101* (2006.01)

(56) References Cited

U.S. PATENT DOCUMENTS 3,504,172 A 3/1970 Liberman
3,746,921 A 7/1973 Marshall et al.
4,369,487 A 1/1983 Carlow
4,627,679 A 12/1986 Billette de Villemeur et al.
4,905,131 A 2/1990 Gary
4,907,767 A 3/1990 Corsi et al.
5,024,614 A 6/1991 Dola et al.
5,062,246 A 11/1991 Sykes
D329,372 S 9/1992 Wilms
D330,479 S 10/1992 Stevens
5,342,221 A 8/1994 Peterson
5,568,129 A 10/1996 Sisselman et al.
5,608,375 A 3/1997 Kosich
D391,915 S 3/1998 Miller
5,792,992 A 8/1998 Handler
D406,050 S 2/1999 DeSouza
D409,077 S 5/1999 Brooks
6,072,708 A 6/2000 Fischer
D436,311 S 1/2001 Edvardsson
6,283,621 B1 9/2001 Macri
6,323,421 B1 11/2001 Pawson et al.
D468,998 S 1/2003 Zadak
6,513,289 B1 2/2003 Decore et al.
6,538,568 B2 3/2003 Conley, III
D487,391 S 3/2004 Balaban
6,739,734 B1 5/2004 Hulgan
D492,189 S 6/2004 Weremchuk et al.
6,979,907 B2 12/2005 Li et al.
7,086,747 B2 8/2006 Nielson et al.
7,140,742 B2 11/2006 Pohlert et al.
7,178,941 B2 2/2007 Roberge et al.
7,227,278 B2 6/2007 Realmuto et al.
7,229,185 B1 6/2007 Galvez et al.
7,360,929 B2 4/2008 Pfund et al.
7,387,407 B2 6/2008 Tseng
7,470,036 B2 12/2008 Deighton et al.
D608,181 S 1/2010 Koizumi
D609,554 S 2/2010 Koizumi
7,663,898 B2 2/2010 Lindemann et al.
7,766,536 B2 8/2010 Peifer et al.
7,828,456 B2 11/2010 Boyer et al.
7,922,354 B2 4/2011 Everhart
7,926,982 B2 4/2011 Liu
7,972,035 B2 7/2011 Boyer
8,018,161 B2 9/2011 Smith, III et al.
8,113,687 B2 2/2012 Villard et al.
8,136,958 B2 3/2012 Verfuerth et al.
8,138,690 B2 3/2012 Chemel et al.
8,294,379 B2 10/2012 Liu et al.
8,299,712 B2 10/2012 Smith, III et al.
8,313,211 B2 11/2012 Libohova et al.
D672,287 S 12/2012 Noble et al.
8,339,069 B2 12/2012 Chemel et al.
8,376,583 B2 2/2013 Wang et al.
8,398,276 B2 3/2013 Pearson et al.
D682,069 S 5/2013 Lehane et al.
8,531,134 B2 9/2013 Chemel et al.
D700,833 S 3/2014 Ng et al.
8,814,376 B2 8/2014 Nicolai et al.
9,052,097 B2 6/2015 Blincoe et al.
D741,146 S 10/2015 Delrue et al.
D752,954 S 4/2016 Lax et al.
9,316,370 B2 4/2016 Lax et al.
9,425,649 B2 8/2016 Singer et al.
9,625,139 B2 4/2017 Lax et al.
9,672,700 B2 6/2017 Lax
9,897,305 B2 2/2018 Ryder et al.
9,909,748 B2 3/2018 Lax et al.
9,995,444 B2 6/2018 Leichner
10,386,027 B1 8/2019 Lax et al.
10,443,827 B2 10/2019 Lax et al.
2002/0140360 A1 10/2002 Crenshaw
2002/0193955 A1 12/2002 Bertness et al.
2003/0072145 A1 4/2003 Nolan et al.
2004/0160199 A1 8/2004 Morgan et al.
2004/0257789 A1 12/2004 Nielson et al.
2005/0018435 A1 1/2005 Selkee et al.
2005/0174755 A1 8/2005 Becker
2005/0190078 A1 9/2005 Salter
2005/0221659 A1 10/2005 Mrakovich et al.
2005/0254237 A1 11/2005 Nath et al.
2006/0215422 A1 9/2006 Laizure, Jr. et al.
2007/0064450 A1 3/2007 Chiba et al.
2007/0070622 A1 3/2007 Allen
2007/0189001 A1 8/2007 Nielson et al.
2007/0195527 A1 8/2007 Russell
2007/0222399 A1 9/2007 Bondy et al.
2007/0247842 A1 10/2007 Zampini et al.
2007/0274084 A1 11/2007 Kan et al.
2008/0080162 A1 4/2008 Wilcox et al.
2008/0155915 A1 7/2008 Howe et al.
2008/0212319 A1 9/2008 Klipstein
2008/0265799 A1 10/2008 Sibert
2008/0297701 A1 12/2008 Lee et al.
2009/0034261 A1 2/2009 Grove
2010/0019690 A1 1/2010 Libohova et al.
2010/0148697 A1 6/2010 Bayat et al.
2010/0244721 A1 9/2010 Shloush et al.
2010/0296285 A1 11/2010 Chemel et al.
2010/0296536 A1 11/2010 Tao
2011/0058358 A1 3/2011 Soo et al.
2011/0292658 A1 12/2011 Ho
2012/0007516 A1 1/2012 Lax et al.
2012/0080944 A1 4/2012 Recker et al.
2012/0127702 A1 5/2012 Lax et al.
2012/0168576 A1 7/2012 Intravatola
2012/0281399 A1* 11/2012 Crookham ..... F21S 8/033 362/231
2013/0201658 A1 8/2013 Bogart et al.
2013/0342342 A1 12/2013 Sabre et al.
2014/0226072 A1 8/2014 Ikuta
2014/0240966 A1 8/2014 Garcia et al.
2014/0254132 A1 9/2014 Nicolai et al.
2014/0320011 A1 10/2014 Hegarty
2015/0009666 A1 1/2015 Keng et al.
2015/0062932 A1 3/2015 Wang et al.
2015/0292695 A1* 10/2015 Lax ..... F21S 9/022 362/20
2015/0330587 A1* 11/2015 Lax ..... F21V 23/02 362/191
2015/0338084 A1 11/2015 Ryder et al.
2016/0035192 A1 2/2016 Lax
2016/0102825 A1 4/2016 Scribante et al.
2016/0323981 A1 11/2016 Clark et al.
2017/0138758 A1 5/2017 Ricci
2017/0184280 A1* 6/2017 Lax ..... F21S 2/005
2017/0254517 A1 9/2017 Nijkamp et al.
2019/0383452 A1 12/2019 Lax et al.

OTHER PUBLICATIONS

ProTran 1, 120 VAC LED Safety Light, Sep. 12, 2008.
ProTran 1, 1000VDC LED Safety Light, Sep. 12, 2008.
ProTran 1, 1000VDC White LED Portable Lamp Bank for MOW, Dec. 20, 2008.
Lumascape, LED Product Catalogue 2008, Mar. 2008.
Copyright 2014, Apogee Translite, Inc., series 98J LED, Spec Sheet.
Apogee Translite, Series 70 LED Tunnel Light webpage, copyright 2015, accessed Sep. 2015 from www.apogeetranslite.com.
Clear-vu lighting Metroguide Pathlight, publication date unknown, document includes date of Sep. 25, 2013.
Apogee Translite, Series 70 LED Tunnel Light, Specification Sheet, copyright 2015.
Jul. 27, 2016 MTA NYCT Enhanced Station Initiative Program Design Criteria Manual; Contract A-36622A.
Jul. 26, 2016 Platform Component Details NCCT Contract A-36622A.
Copyright 2014, Apogee Translite, Inc., series 99 EM LED, Spec Sheet.

(56) References Cited

OTHER PUBLICATIONS

United States District Court for the Eastern District of New York Central Islip Division, Case 2:19-cv-06268-MKB-ST, Defendant's Local Patent Rule 7 Invalidity Contentions.
USPTO, Jan. 8, 2021, office action in U.S. Appl. No. 16/454,674.

* cited by examiner

BI-LEVEL LIGHT FIXTURE FOR PUBLIC TRANSPORTATION TUNNELS

CROSS REFERENCE TO RELATED APPLICATIONS

This application claims the benefit of U.S. Provisional Patent Application No. 62/826,509 filed Mar. 29, 2019 and claims the benefit of U.S. Provisional Patent Application No. 62/985,268 filed Mar. 4, 2020; the disclosures of both applications are incorporated herein by reference.

BACKGROUND OF THE DISCLOSURE

1. Technical Field

The present disclosure relates to light fixtures and, more particularly, to bi-level light fixtures used in public transportation facilities. Specifically, the disclosure relates to bi-level light fixtures used in train tunnels to provide normal use lower-lumen downlighting with selective higher-lumen task lighting which can be directed downward from the fixture, upward from the fixture, or in both directions.

2. Background Information

Underground train systems are numerous in various public and private applications. Various architectural and safety codes dictate lighting requirements for the facilities including the lighting of the train tunnels themselves as well as the maintenance walkways within the tunnels. Despite the headlights on the trains themselves, the systems light the track tunnels with pathway light fixtures disposed along the sides of the tunnels. These light fixtures also light maintenance walkways disposed along the sides of the tunnels. The pathway light fixtures typically shine down to light the track and walkways at a low lumen level without shining upwardly or laterally to avoid distracting the train operators.

National Fire Protection Association (NFPA®) 130, Standard for Fixed Guideway Transit and Passenger Rail Systems, requires illumination at the level of at least 0.25 foot-candles for underground or enclosed trainway walkways and walking surfaces measured at the walking surface. At the same time, Occupational Safety and Health Administration (OSHA®) requires a 5.00 foot-candle illumination level in a tunnel while maintenance work is being conducted. When only low lumen track lighting is present, maintenance workers must bring in their own portable light fixtures to illuminate the work areas to the correct illumination level.

SUMMARY OF THE DISCLOSURE

The different configurations of the light fixtures and systems described herein can be used in transportation systems and, in particular, within underground train tunnels. The light systems and light fixtures also may be used in architectural applications.

The disclosure provides a light fixture which provides normal mode downlighting for track and walkway lighting and a selective task lighting mode where higher-lumen lighting is provided in at least the same downlighting direction as the track and walkway lighting. The normal lighting illumination level provides at least 0.25 to 2.00 foot-candles at the illuminated surfaces. The normal mode downlighting eliminates a stroboscopic effect created when evenly spaced lights are viewed down a tunnel. The task lighting mode provides at least 5.00 foot-candles to the same illuminated surfaces. The task lighting mode is achieved with the same light source that provides the normal mode lighting or with additional light sources that are activated together with or instead of the normal lighting mode light sources. The light sources can be a plurality light emitting diode (LED) engines that include a plurality of LEDs.

The disclosure also provides a light fixture that includes a light source such as an LED light engine arranged to project light upwardly when the task lighting mode of the light fixture is activated. The uplighting illuminates ceilings to at least 5.00 foot-candles for task work performed above and in the proximity of the light fixtures.

The disclosure provides that the higher-lumen task lighting mode can be activated by a user via a switch on the fixture itself or a switch that activates the task lighting mode in a plurality of fixtures. The switches can be local to the fixture(s) or located remotely.

The disclosure also provides a configuration with a timer that keeps the light fixture or a group of light fixtures in the task lighting mode for a set amount of time after the task lighting mode is activated.

The disclosure provides mounting bracket configurations for the light fixture that allow the fixtures to be readily mounted and dismounted for repair or replacement. A quick disconnect fitting can be used with the power cord for the fixture.

The disclosure provides an exemplary light fixture configuration that includes a battery backup system activated during power failures.

The preceding non-limiting aspects of the disclosure, as well as others, are more particularly described below. A more complete understanding of the fixtures, systems, and methods can be obtained by reference to the accompanying drawings, which are not intended to indicate relative size and dimensions of the assemblies or components thereof. In those drawings and the description below, like numeric designations refer to components of like function. Specific terms used in that description are intended to refer only to the particular structure of the embodiments selected for illustration in the drawings, and are not intended to define or limit the scope of the disclosure.

BRIEF DESCRIPTION OF THE DRAWINGS

Similar reference numbers refer to similar elements in the drawings.

DETAILED DESCRIPTION OF THE DISCLOSURE

Figure 1:
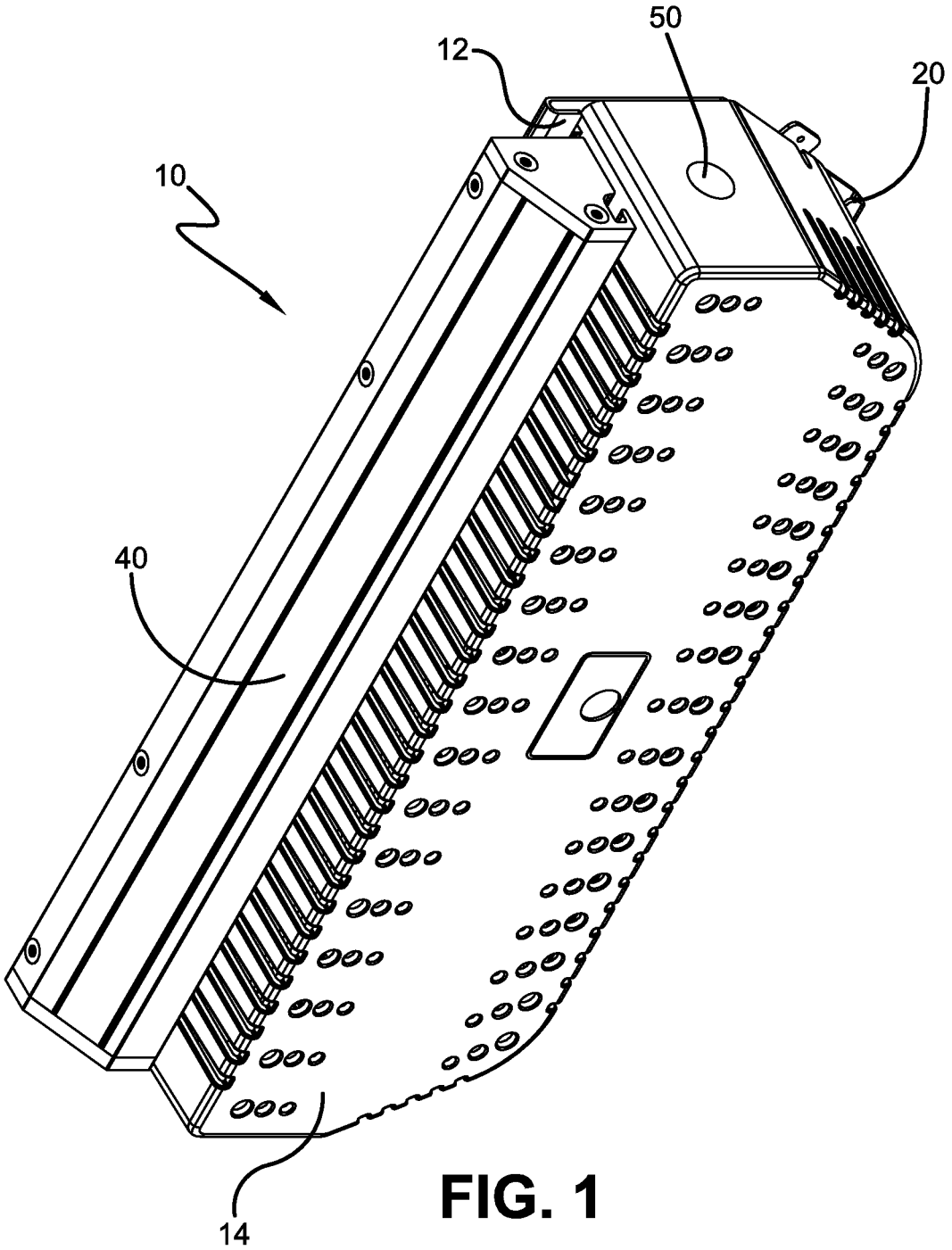
FIG. 1 is a perspective view of an exemplary bi-level light fixture of the disclosure.
Figure 5:
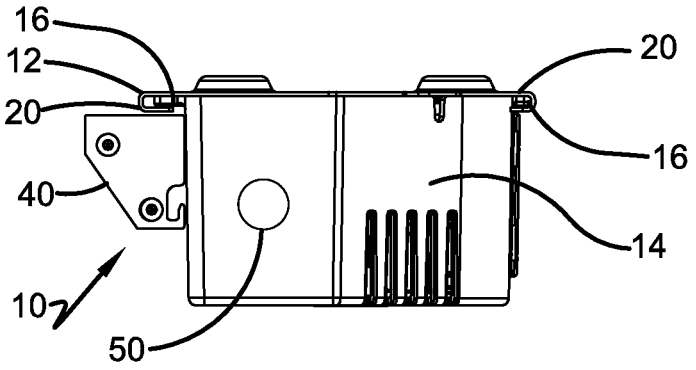
FIG. 5 is a right side elevation view thereof.
Figure 2:
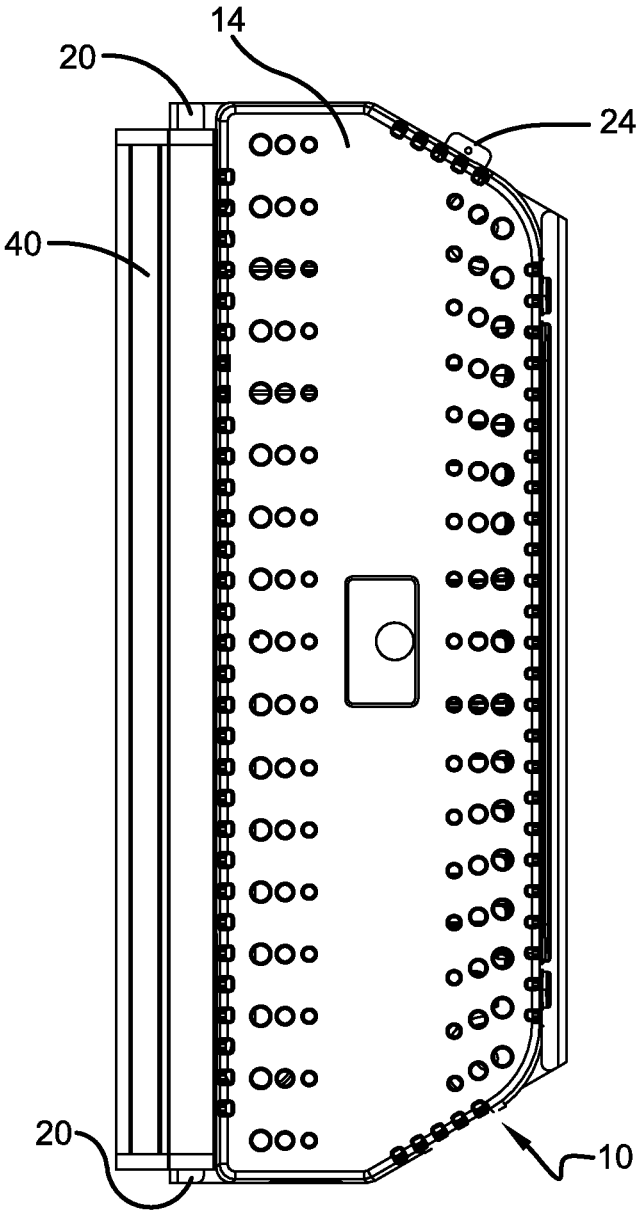
FIG. 2 is a front elevation thereof.
Figure 3:
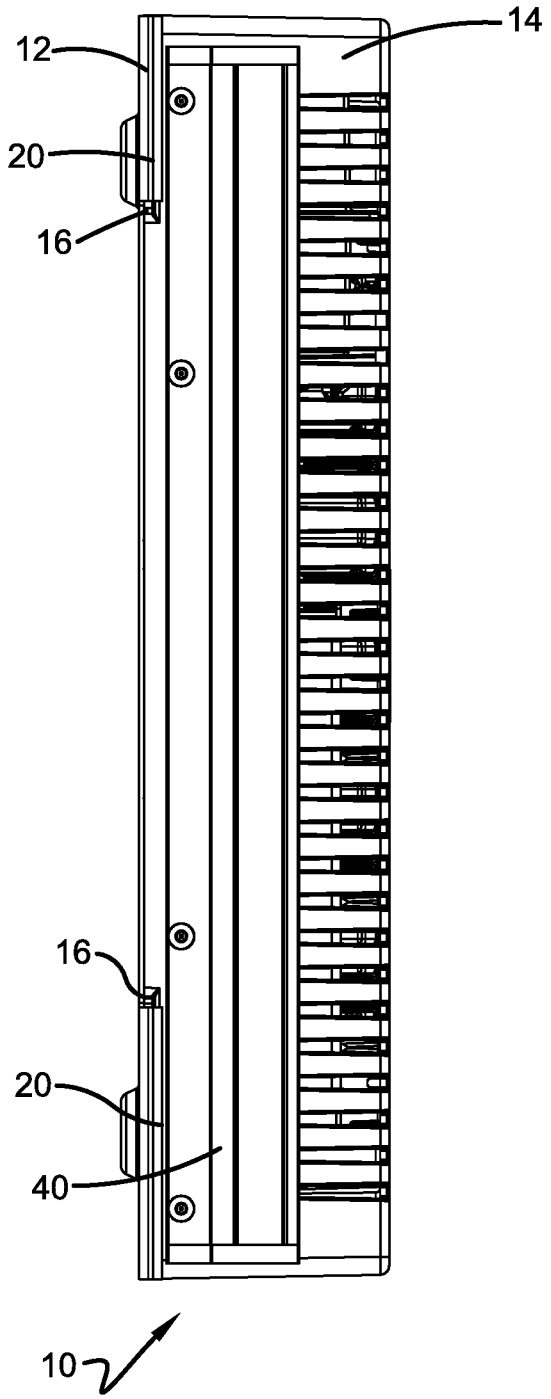
FIG. 3 is a top plan view thereof.
Figure 4:
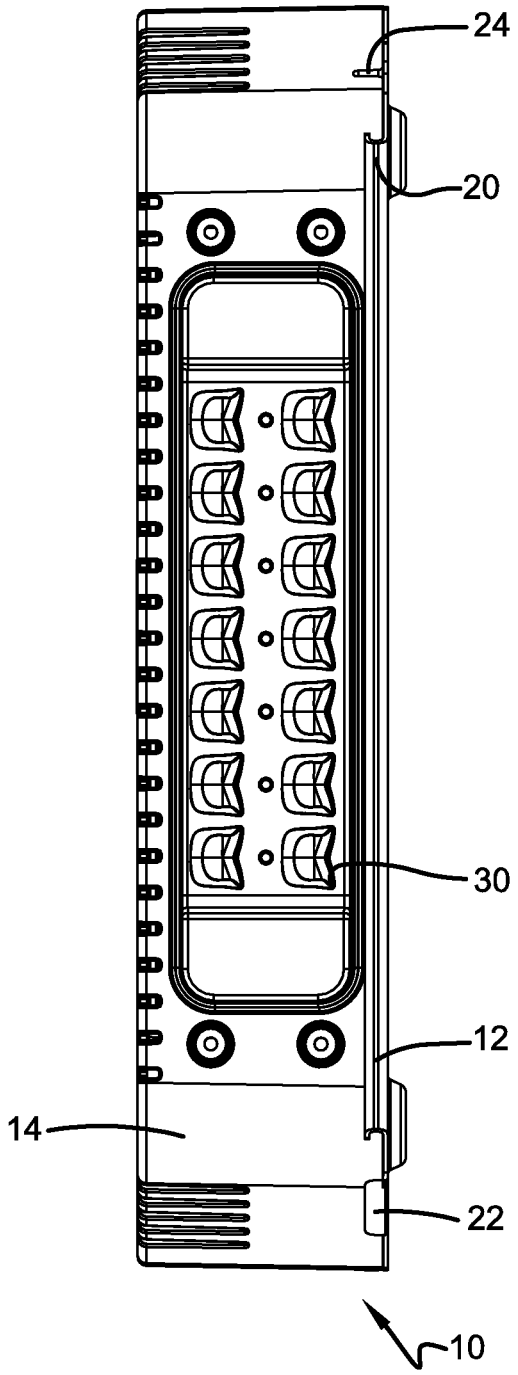
FIG. 4 is a bottom plan view thereof.

Exemplary configurations for bi-level light fixtures for a public transportation tunnel are indicated generally by the reference numeral 10 in the accompanying drawings. The exemplary configurations of the light fixture, the systems, and the methods described herein are with reference to a public transportation facility such as a train tunnel. Fixtures 10, the systems, and the methods also can be used in other applications where selective task lighting is desired. Fixtures 10, the systems, and the methods can be used in architectural applications. In general, light fixture 10 provides normal mode downlighting for track and walkway lighting and a selective task lighting mode where higher-lumen lighting is provided in at least the same downlighting direction as the track and walkway lighting. Fixtures 10 optionally include a lighting source that provides selective uplighting in the task lighting mode. Fixtures 10 can be mounted to the sidewalls that define the train tunnel where fixtures 10 provide light down onto the train tracks as well as onto the walkways along the sides of the tracks. The sidewalls can be vertical, angled, or curved.

Each configuration of fixture 10 can be mounted on a bracket 12 that supports a fixture housing 14. Each fixture housing is IP (Ingress Protection) 65 rated and IK10 impact resistant. Fixture 10 has an operating temperature range of −20 deg F to 130 deg F.

In FIGS. 1-5, an exemplary mounting bracket 12 is used to mount light fixture 10 to a facility wall or other structure which will carry fixture 10 during use. Mounting bracket 12 allows light fixture 10 to be quickly mounted and dismounted. The connection between the fixture and the mounting bracket can be a frictional connection, a snap fit connection, a connection secured with one or more fasteners, gravity, or a combination of these. Mounting bracket 12 is often directly connected to concrete walls with suitable anchors. Mounting bracket 12 can be made from stainless steel, aluminum, or a polymer. The housing 14 of light fixture 10 can be made from steel, stainless steel, galvanized steel, aluminum, polycarbonate, or a different polymer. When made from aluminum, direct contact between stainless steel and aluminum is undesirable especially in hot humid environments because of galvanic corrosion. In these situations, a spacer may be used to prevent direct contact between the two metals while also providing a shock absorber against the repeated vibration forces to which fixture 10 is subjected. The spacer can be made from an insulating material such as a polymer, a rubber, fiberglass, PVC, or other insulating material.

In one exemplary configuration shown in FIGS. 1-5, a light fixture housing 14 includes spaced upper mounting tabs 16 and a lower mounting tab 18 that slide into channels 20 defined by mounting bracket 12. A stop 22 projects forwardly from the rear wall of mounting bracket 12 to stop light fixture housing 14 from sliding all the way through mounting bracket 12. A lock tab 24 supports a removable second stop which may be a threaded connector or a rubber knob supported by a threaded connector to lock light fixture housing 14 in between stop 22 and the second stop.

Figure 6:
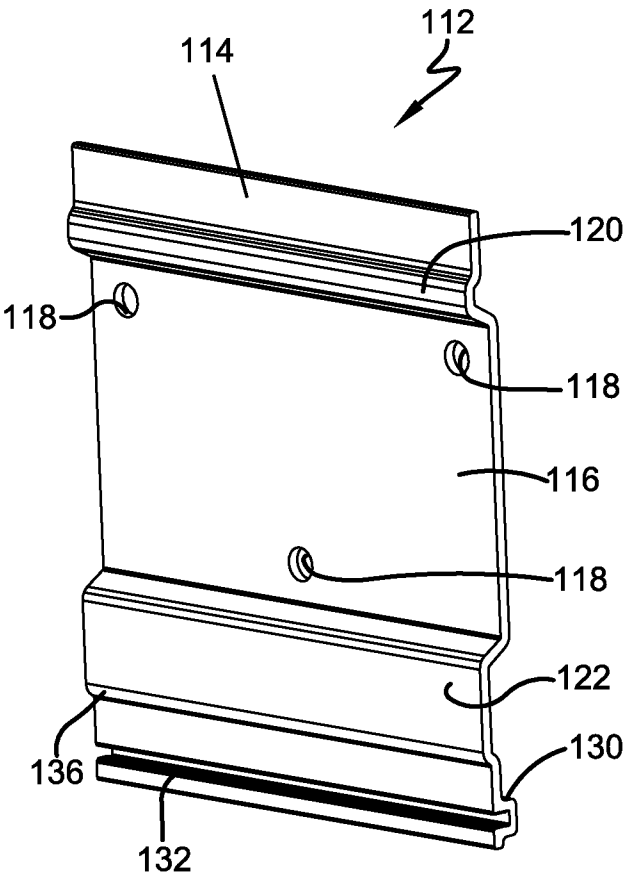
FIG. 6 is a perspective view of an exemplary mounting bracket.
Figure 8:
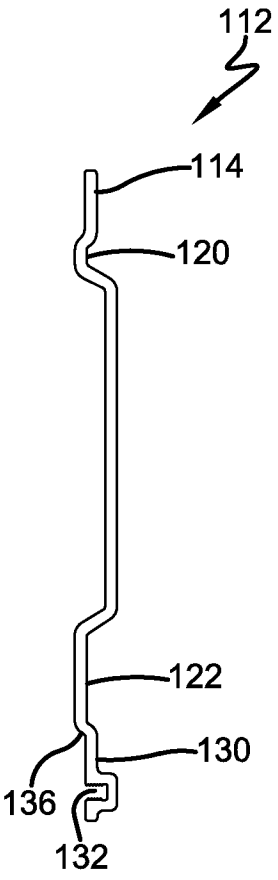
FIG. 8 is an end view of FIG. 6.
Figure 7:
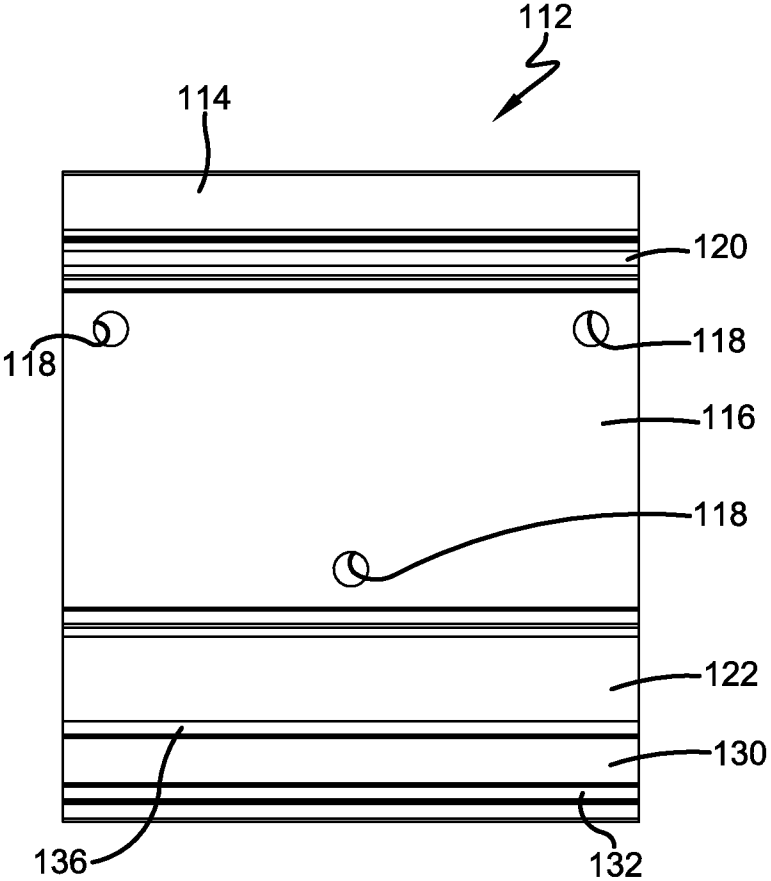
FIG. 7 is a front elevation view of FIG. 6.

FIGS. 6-8 depict another exemplary mounting bracket 112 that provides an upwardly projecting flange 114 upon which fixture housing 14 hangs. A spacer or vibration damper can be carried by flange 114. Mounting bracket 112 can be extruded and can be made from aluminum. Mounting bracket 112 includes a main body 116 that defines the rear surface of bracket 112 that contacts the structure upon which bracket 112 is mounted. Main body 116 defines a plurality of openings 118 for fasteners that secure bracket 112 to the structure that can be a wall of tunnel to another mounting structure such as mounting rails. Mounting bracket 112 includes an upper rail 120 and a lower rail 122 that project forward from the front surface of main body 116 to provide space between the rear of fixture housing 14 and the front surface of main body 116. This space provides room for the fasteners and allows air to flow behind fixture housing 14. The rear surface of fixture housing 14 engages the front surfaces of rails 120 and 122. Flange 114 projects up from the top of upper rail 120 with its front surface disposed behind the front surface of rail 120 and its rear surface disposed in front of at least the rear surface of main body 116 so provide room for a portion of fixture housing 14 to fit behind flange 114 when fixture housing 14 is installed. The rear surface of flange 114 can be disposed in front of the front surface of main body 116 as depicted in the drawings.

Figure 9:
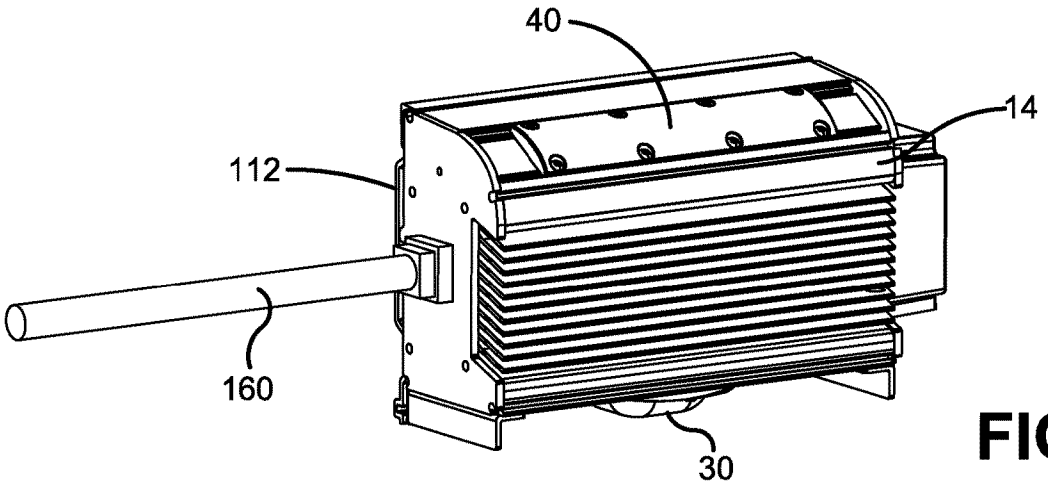
FIG. 9 is a perspective view of an exemplary light fixture mounted to the mounting bracket of FIG. 6.
Figure 10:
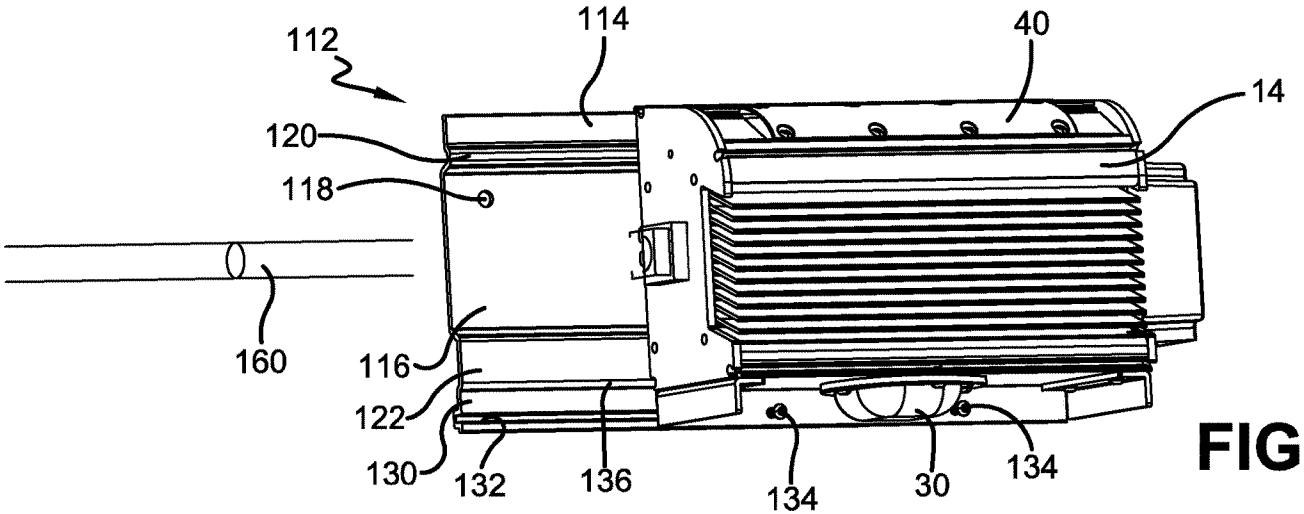
FIG. 10 is a perspective view of the light fixture of FIG. 9 being removed from the bracket of FIG. 6.
Figure 14:
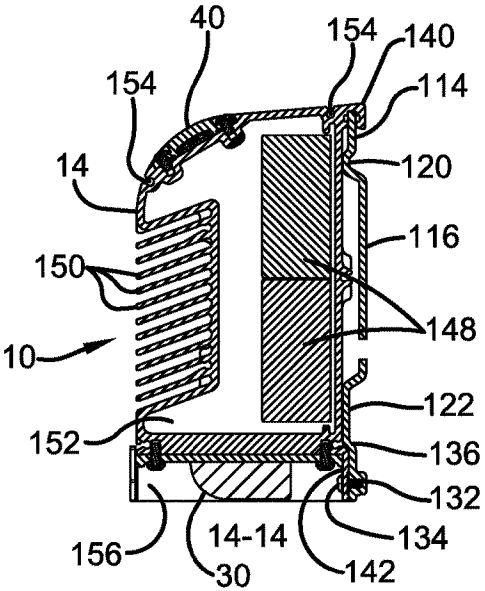
FIG. 14 is a section view taken along line 14-14 of FIG. 12.
Figure 13:
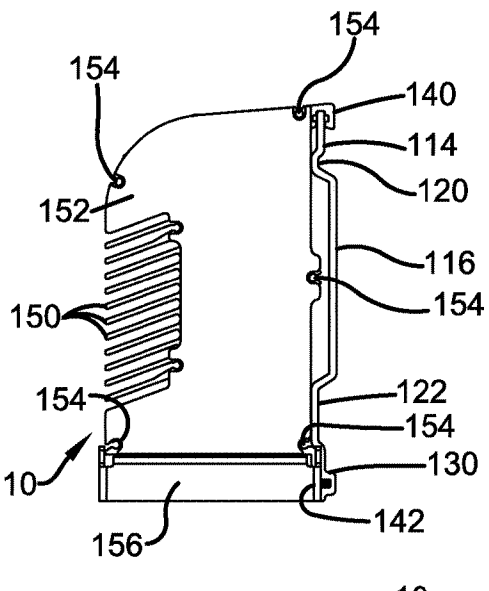
FIG. 13 is an end view of FIG. 11.
Figure 12:
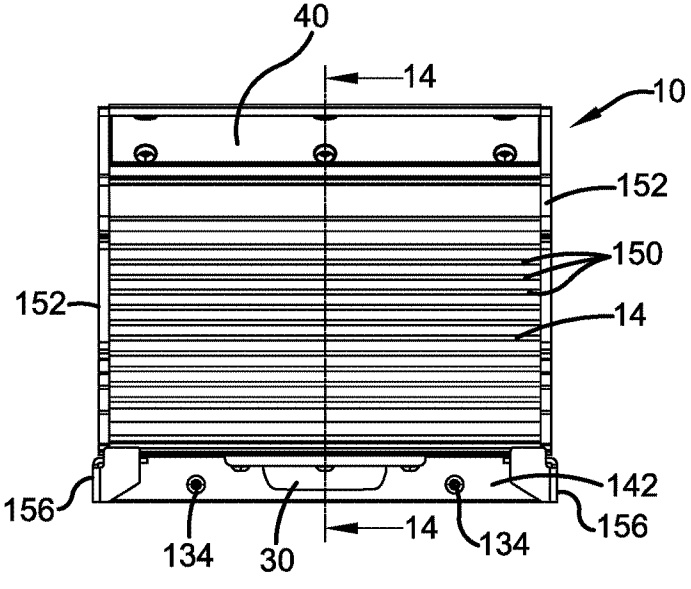
FIG. 12 is a front elevation of FIG. 11.
Figure 11:
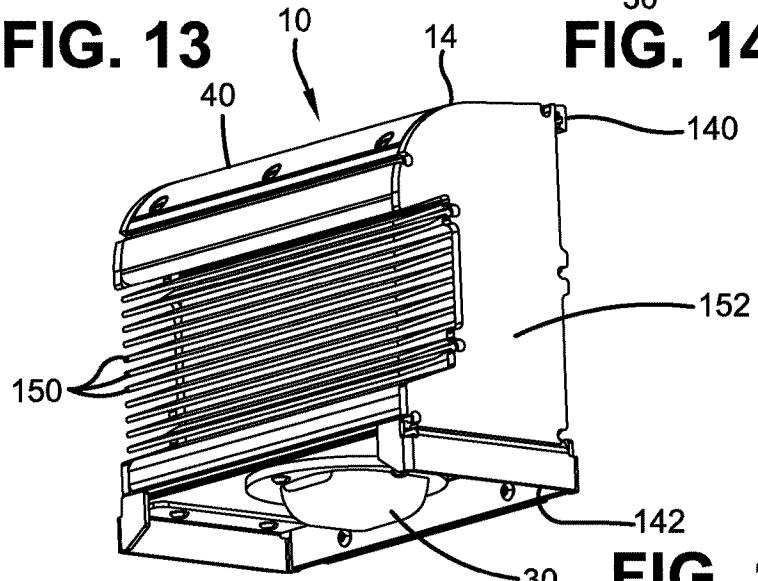
FIG. 11 is a perspective view of an exemplary light fixture mounted to the bracket of FIG. 6.
Figure 15:
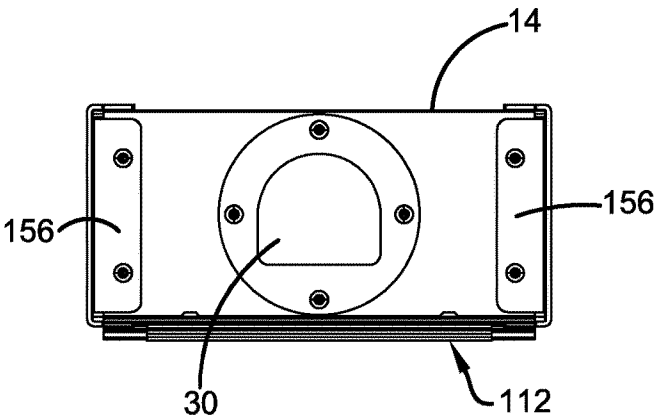
FIG. 15 is a bottom view of FIG. 11.
Figure 19:
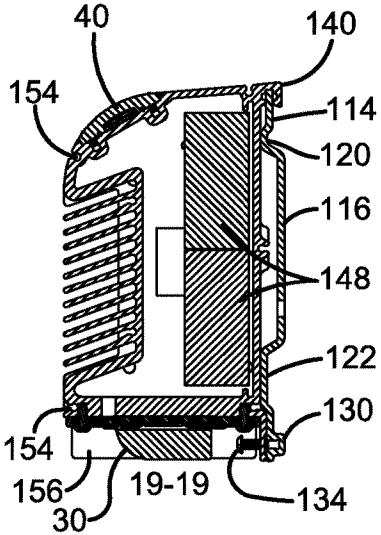
FIG. 19 is a section view taken along line 19-19 of FIG. 17.
Figure 18:
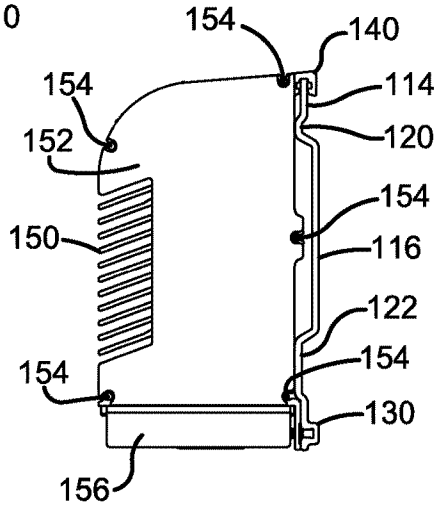
FIG. 18 is an end view of FIG. 16.
Figure 17:
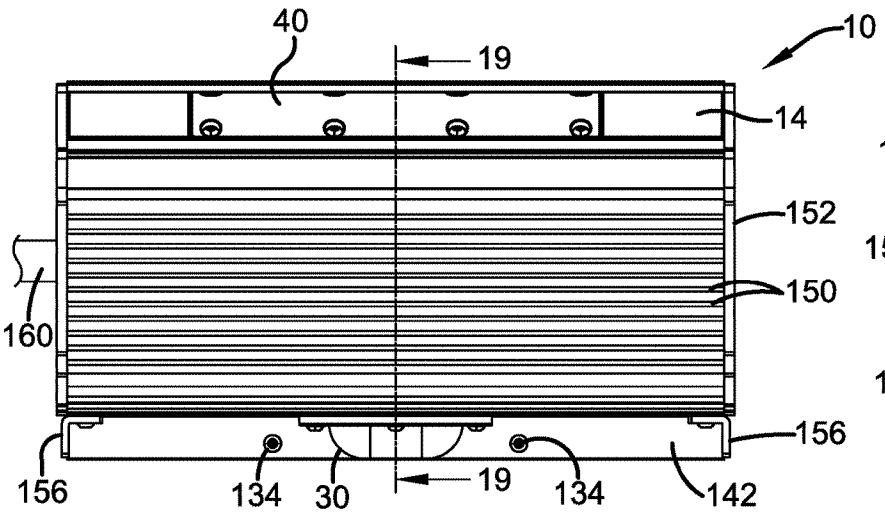
FIG. 17 is a front elevation of FIG. 16.
Figure 16:
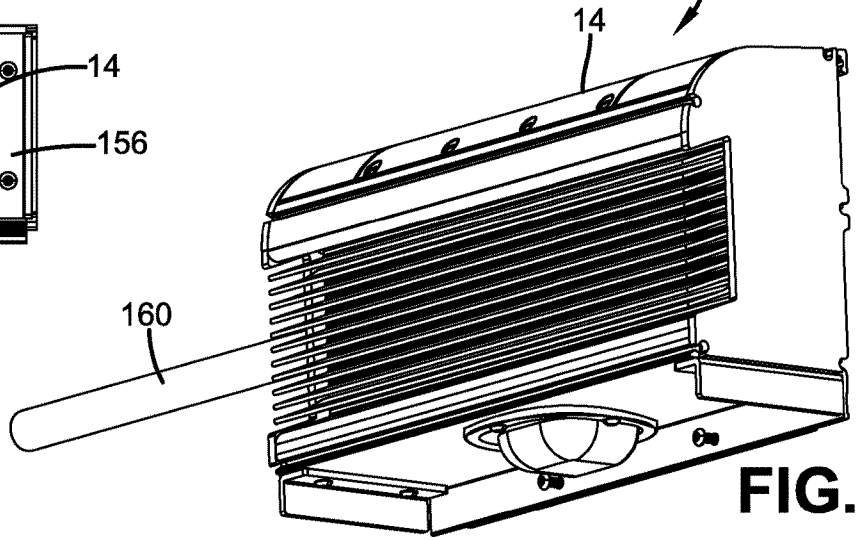
FIG. 16 is a perspective view of an exemplary light fixture mounted to the bracket of FIG. 6.
Figure 20:
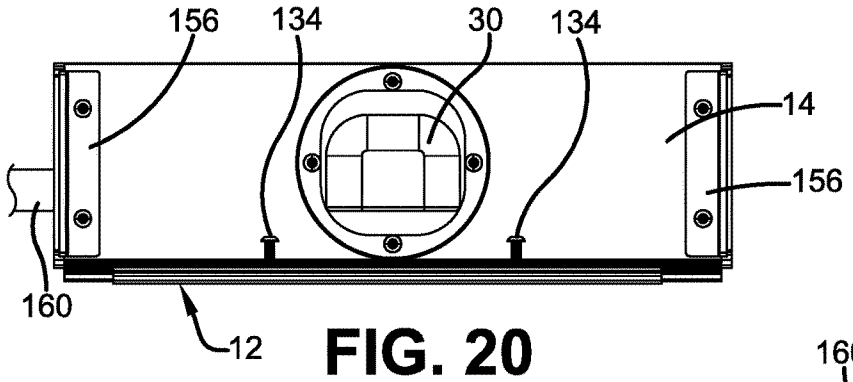
FIG. 20 is a bottom view of FIG. 16.
Figure 24:
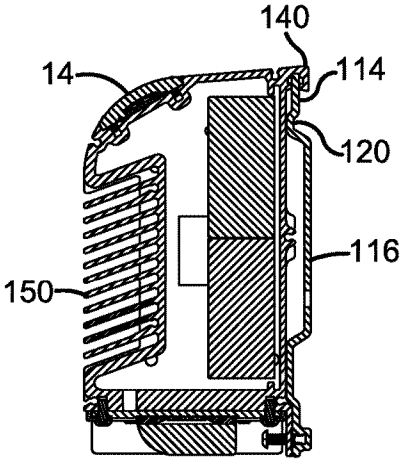
FIG. 24 is a section view taken along line 24-24 of FIG. 22.
Figure 23:
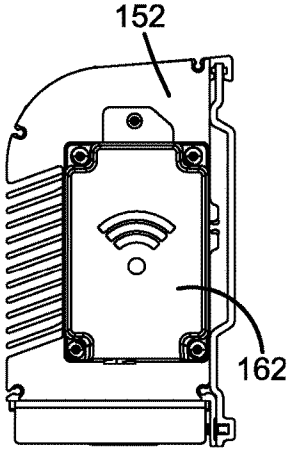
FIG. 23 is an end view of FIG. 21.
Figure 22:
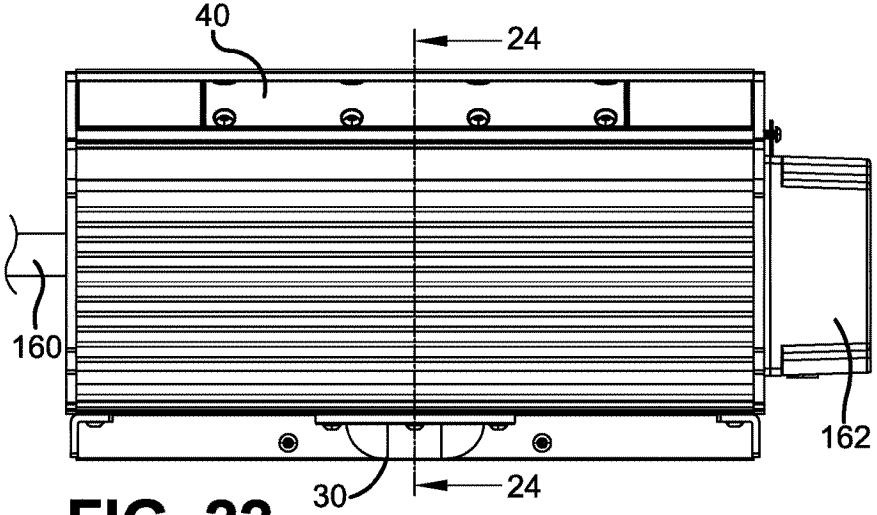
FIG. 22 is a front elevation of FIG. 21.
Figure 21:
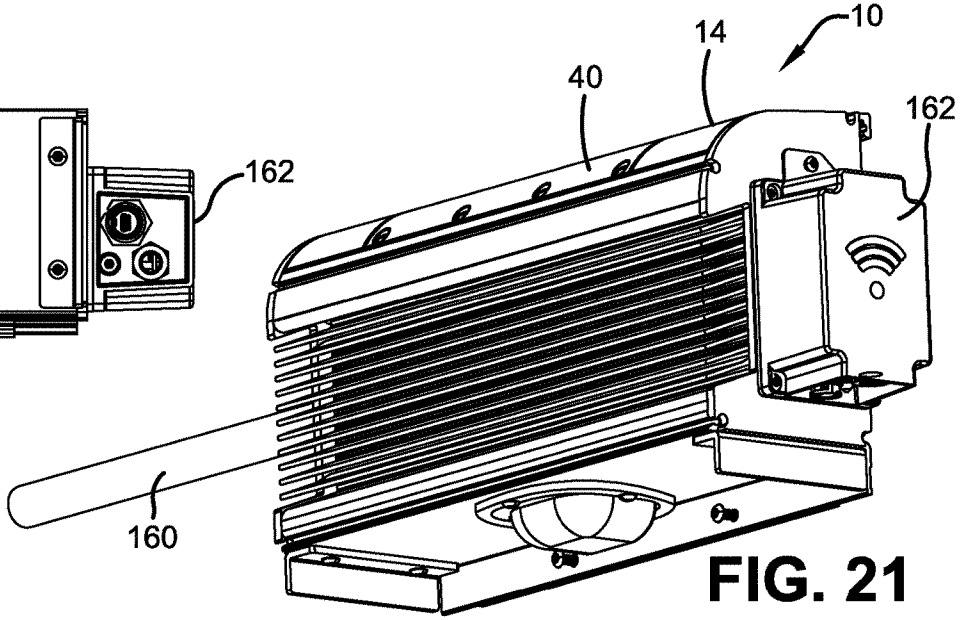
FIG. 21 is a perspective view of an exemplary light fixture mounted to the bracket of FIG. 6.
Figure 25:
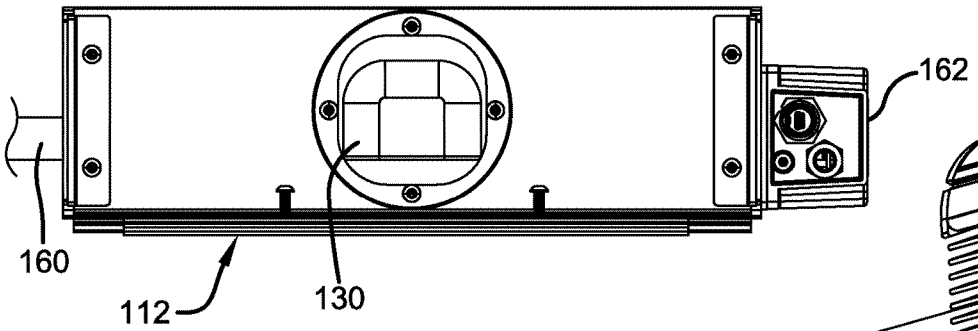
FIG. 25 is a bottom view of FIG. 21.

A lower flange 130 projects down from lower rail 122 and defines a fastener channel 132 that receives fasteners 134 that secure fixture housing 14 to bracket 112. The rear surface of lower flange 130 is co-planar with the rear surface of main body 116 so that it will also engage a flat mounting structure such as a flat wall. The front surface of lower flange 130 is disposed behind the front surface of lower rail 122 to define a shoulder 136 that helps locate fixture housing 14 during installation. Fixture housing 14 can be mounted to and dismounted from bracket 112 by sliding it over the end of bracket 112 as shown in FIGS. 9 and 10. Fixture housing 14 can also be removed in an upward direct after fasteners 134 are removed.

FIGS. 11-15 depict an exemplary light fixture 10 mounted to mounting bracket 112. This configuration of light fixture 10 has its fixture housing 14 configured to cooperate with mounting bracket 112. A hook 140 projects rearwardly from the top of fixture housing 14 with the hook opening downwardly. Hook 140 fits over flange 114 to support fixture housing 14 on mounting bracket 112. Hook 140 has open ends so that fixture housing 14 can slide off of flange 114. Fixture body 14 also includes a downwardly projecting fastener wall 142 having a rear surface disposed behind the rear surface of fixture housing 14 such that it engages the front surface of lower flange 130. Fastener wall 142 defines openings that receive fasteners 134 in alignment with channel 132. The front of fastener wall 142 is accessible so that fasteners 134 can be installed, removed, and reinstalled without opening fixture housing 14. A ledge is defined between the top rear surface of fastener wall 142 and the rear surface of fixture housing 14. That ledge engages shoulder 136 when fixture housing 14 is correctly seated against bracket 112.

Fixture housing 14 is extruded and defines an open interior sized to receive LED power supplies 148 that use electrical quick connects. Optional batteries can be carried within fixture housing 14. The front of fixture housing defines plurality of cooling fins 150. The ends of the extruded body are closed with end caps 152. End caps 152 are connected to the extruded main body with fasteners that are receives in fastener channels 154 formed integral with the main body. Downwardly projecting end shades 156 can be connected to limit light shining laterally from fixture 10 toward a train conductor.

The LED circuit boards are mounted to portions of the main body of fixture housing 14 which allows the main body to function as a heat sink. Protective lens are disposed over the LEDs.

The configurations of FIGS. 16-25 include a fixed conduit 160 for the power input to light fixture 10. The configuration of FIGS. 21-25 include a wireless communication module 162 that allows light fixture 10 to be remotely controlled.

Figure 26:
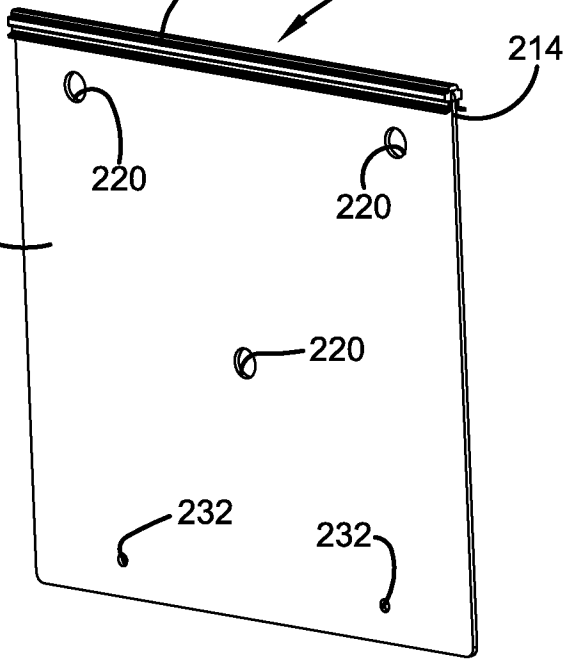
FIG. 26 is a perspective view of an exemplary mounting bracket.
Figure 28:
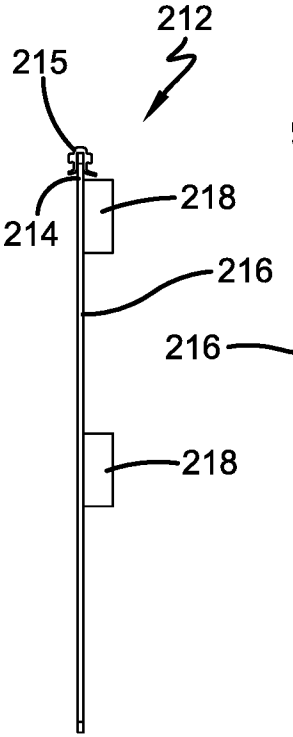
FIG. 28 is an end view of FIG. 26.
Figure 27:
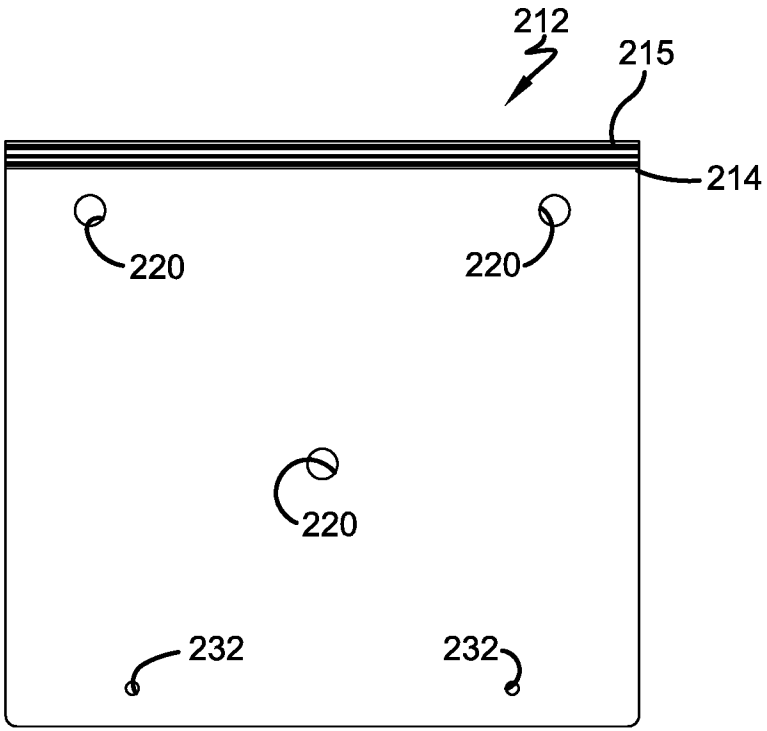
FIG. 27 is a front elevation view of FIG. 26.
Figure 32:
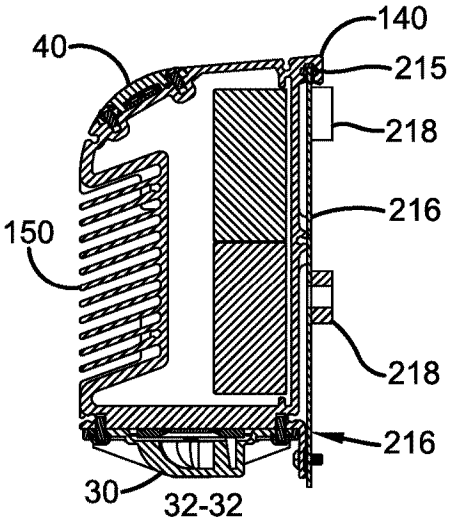
FIG. 32 is a section view taken along line 32-32 of FIG. 30.
Figure 31:
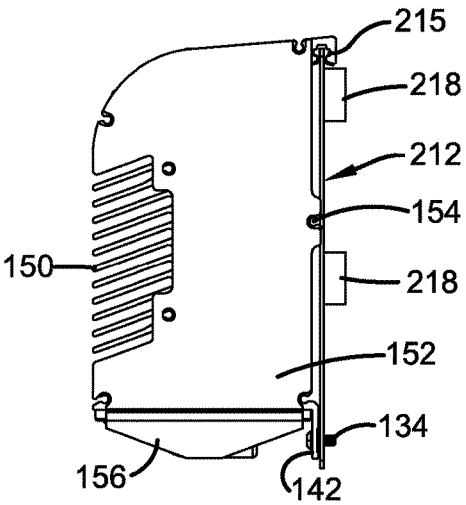
FIG. 31 is an end view of FIG. 29.
Figure 29:
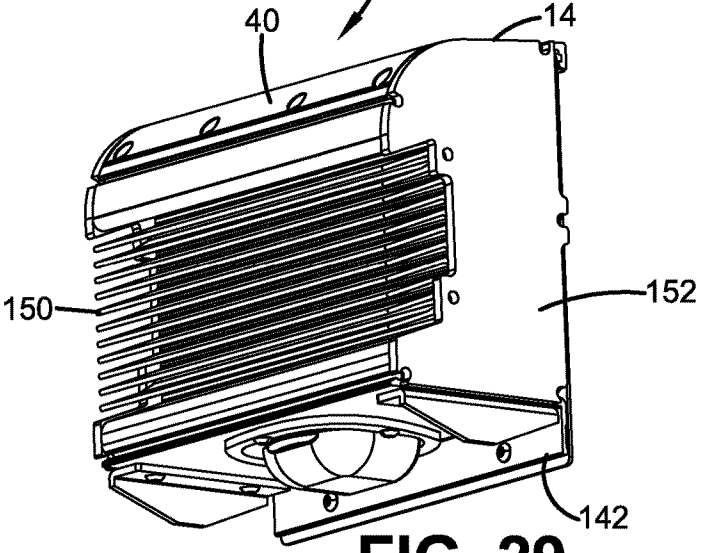
FIG. 29 is a perspective view of an exemplary light fixture mounted to the bracket of FIG. 26.
Figure 30:
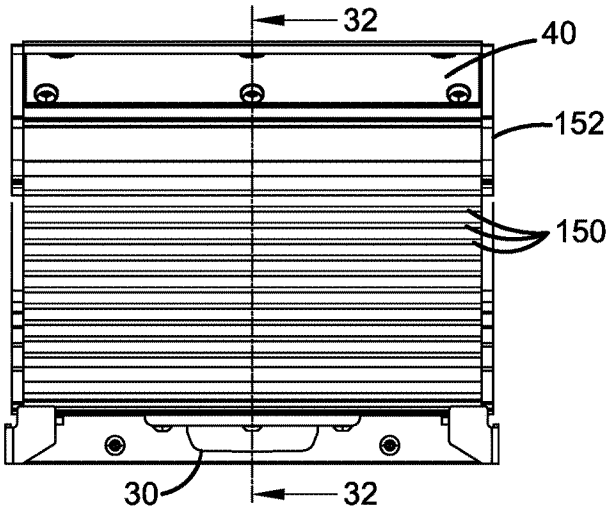
FIG. 30 is a front elevation of FIG. 29.
Figure 33:
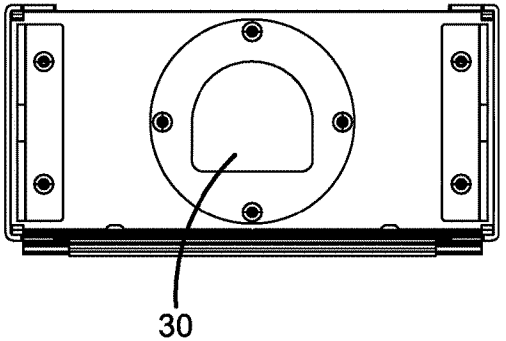
FIG. 33 is a bottom view of FIG. 29.

FIGS. 26-28 depict another exemplary mounting bracket 212 that provides an upwardly projecting flange 214 upon which fixture housing 14 hangs. A spacer, gasket, or vibration damper 215 can be carried by flange 214. Gasket 215 can be made from a polymer. Mounting bracket 212 includes a main body 216 that defines the rear surface of bracket 212 and includes feet 218 that contact the structure upon which bracket 212 is mounted to space the rear surface of main body 216 from the mounting structure. Main body 216 defines a plurality of openings 220 for fasteners that secure bracket 212 to the structure that can be a wall of tunnel to another mounting structure such as mounting rails. Feet 218 can be disposed adjacent each or some of openings 220. Main body 216 also defines openings 232 arranged to receive fasteners 134.

FIGS. 29-33 depict an exemplary light fixture 10 supported by mounting bracket 212 with gasket 215 disposed in the opening of hook 140.

Figure 34:
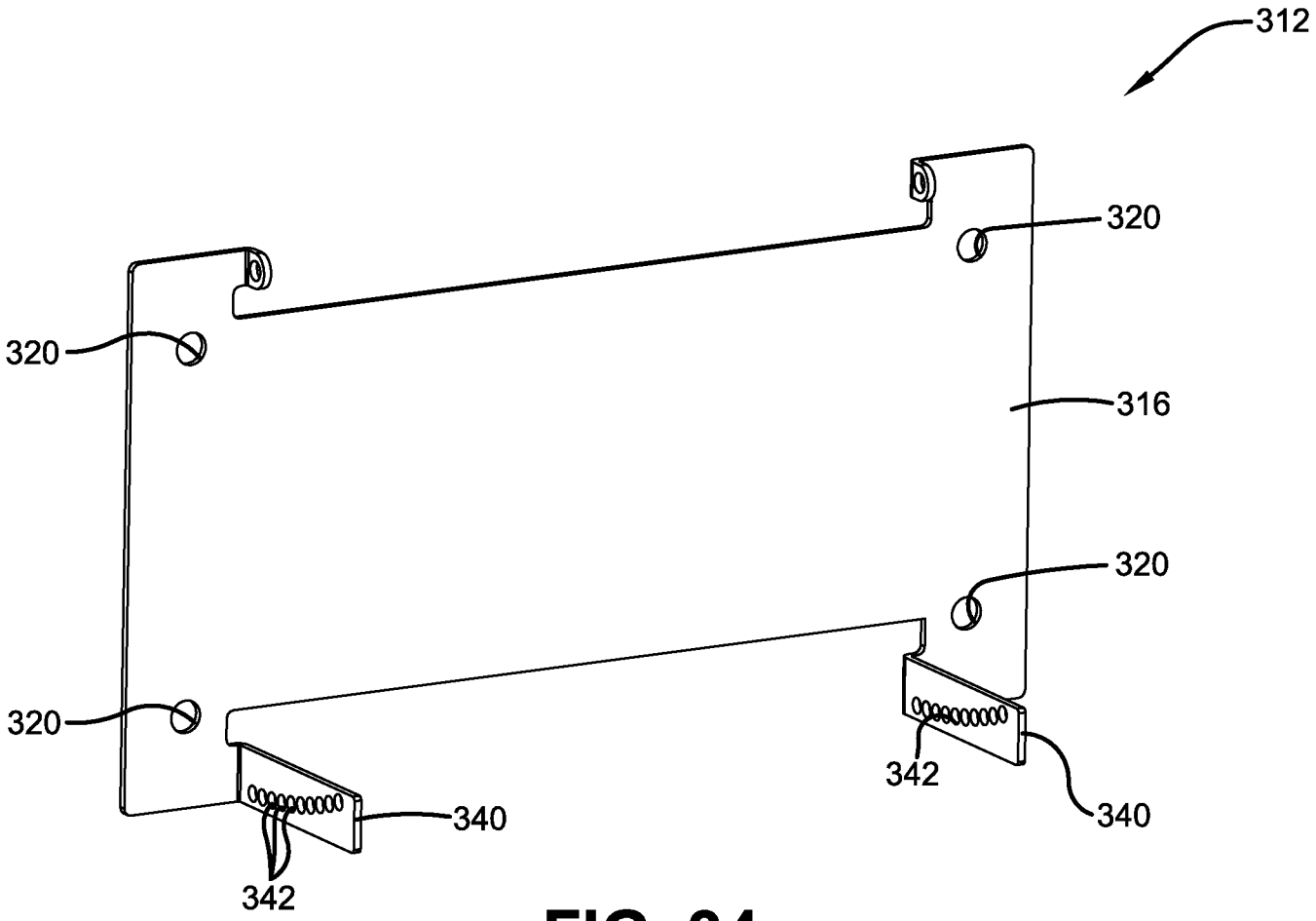
FIG. 34 is a perspective view of a mounting bracket for the light fixture.
Figure 35:
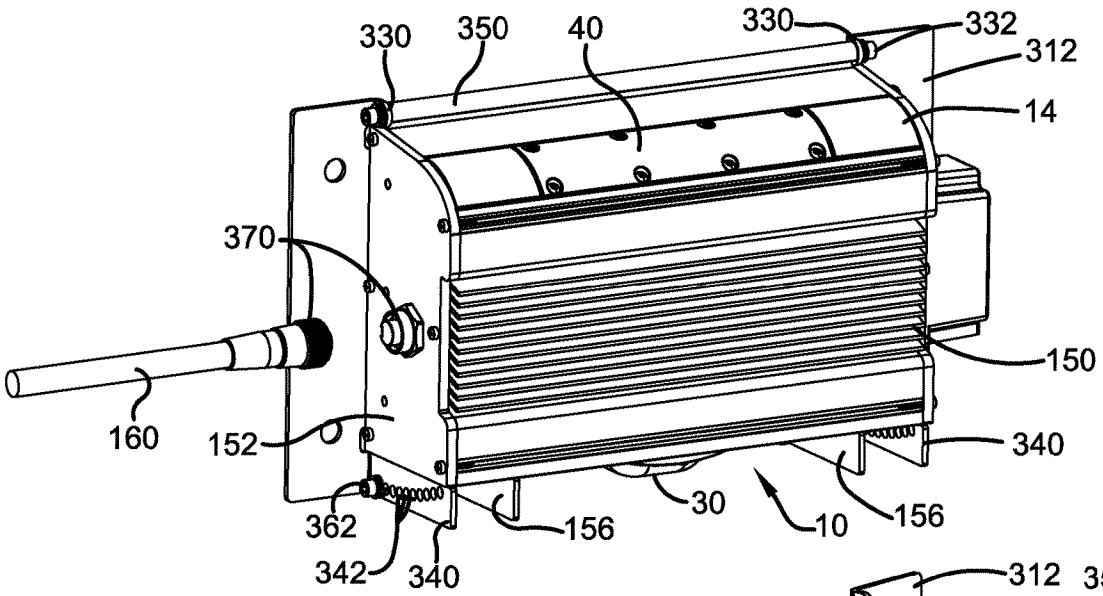
FIG. 35 is a perspective view of a light fixture mounted to the mounting bracket of FIG. 34.
Figure 36:
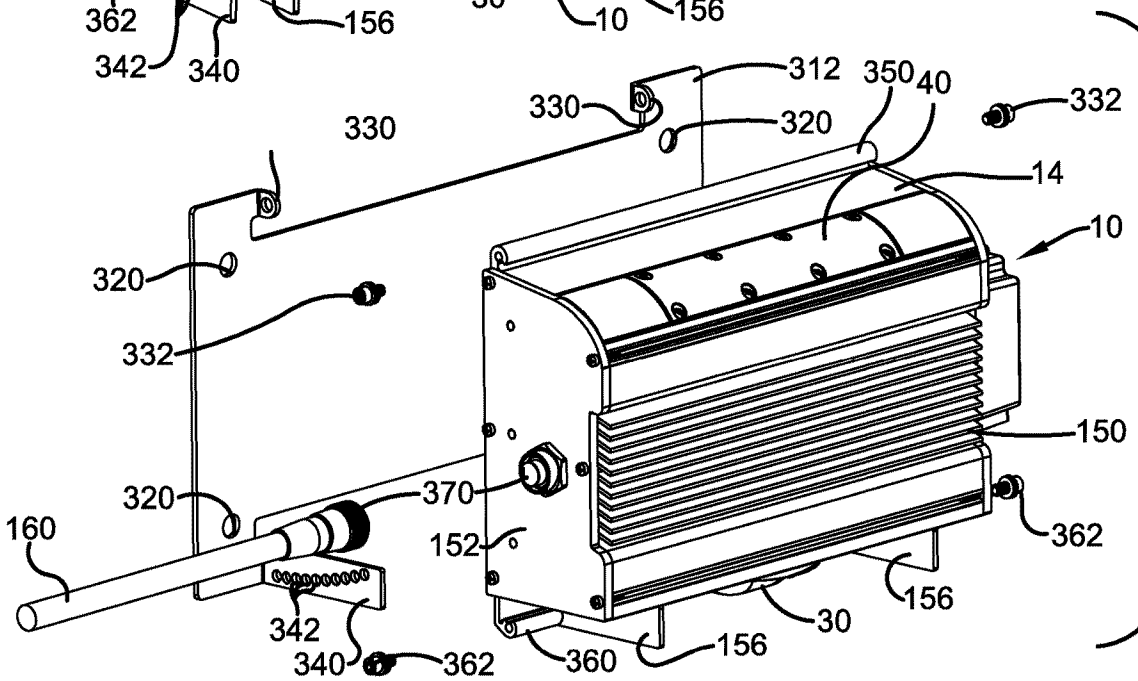
FIG. 36 is an exploded view of FIG. 35.

FIGS. 34-36 depicts an exemplary mounting bracket 312 that allows the position of light fixture 10 to be adjusted if mounting bracket 312 is not mounted vertically. Mounting bracket 312 includes a main body 316 that defines a plurality of openings 320 for fasteners that secure mounting bracket 312 to a support structure such as a tunnel wall. Mounting bracket 312 includes a pair of spaced upper tabs 330 that each define a fastener opening sized to receive a mounting fastener 332 that secures light fixture 10 to mounting bracket 312 with a pivoting connection. Mounting bracket 312 includes a pair of spaced lower tabs 340 that define a plurality of fastener openings 342 disposed along an arc. Fixture housing 14 includes an upper closed hook 350 sized to fit between upper tabs 330. Closed hook 350 defines an opening that receives fasteners 332 to secure fixture housing 14 to mounting bracket 312. Fixture housing 14 also includes a pair of lower closed hooks 360 positioned to be disposed next to lower tabs 340. Closed hooks 360 define openings that receives fasteners 362 to lock the position of light fixture 10 with respect to mounting bracket 312.

FIG. 36 depicts the electrical quick connect 370 between light fixture 10 and conduit 160.

Light fixtures 10 include at least a first light source 30 that provides downlighting. Light source 30 includes one or more LED light engines that are powered by one or more power supplies that are either carried by fixture housing 14 or located remote from housing 14. First light source 30 can be a 3500K CCT rated at greater than 50,000 hours; LM79/LM80 compliant. First light source 30 provides 4560 Lumens at up to 40 Watts. In the exemplary configuration of FIGS. 1-5, light source 30 includes a plurality of LEDs (See FIG. 4 where fourteen LEDs are depicted as an example) that are all powered during the normal downlighting mode. During the normal mode, these LEDs provide 0.25 to 2.00 foot-candles of illumination to a target horizontal surface disposed six to fourteen feet below fixture 10. In a second configuration, only a portion of the LEDs in light source 30 are used during the normal downlighting mode. Substantially all of the light produced by light source 30 is directed downward so as to not shine directly at an oncoming train and to prevent any stroboscopic effect created when evenly spaced rings of light are viewed from a train moving through the lights.

Light fixtures 10 have a task lighting mode where light source 30 is changed to produce higher lumens. The task lighting mode provides at least 5.00 foot-candles to the same target surface. The task lighting mode can provide 5.00 to 50.00 foot-candles to the same target surface and the exemplary embodiment supplies light in a range of 5.00 fc to 25.00 fc. In the first configuration, the task lighting mode is achieved with the same light source 30 by powering the same LEDs with more power to increase their lumen output. This is achieved by increasing the current applied to the same group of LEDs during the task lighting mode. In the example depicted in FIGS. 1-5, the first configuration increases the power delivered to all fourteen LEDs of FIG. 4 such that each outputs more lumens and provides the desired illumination. In the second configuration, the task lighting mode powers another portion of the LEDs so that more LEDs are being used in the task lighting mode than in the normal mode. In the example depicted in the drawings, seven of the LEDs of FIG. 4 can be used in the normal lighting mode with seven remaining off. In the task lighting mode, the additional seven LEDs are powered to supply the task lighting at the desired illumination level. In the second configuration, an option is to also power the first portion (the first seven) of the LEDs used during the normal mode at the higher power level so that all (all fourteen) of the available LEDs are used during the task lighting mode.

Light fixtures 10 can optionally include a second light source 40 in the form of an uplighting lighting source 40 arranged for uplighting during the task lighting mode. Second light source 40 provides 1000 Lumens at up to 12 Watts. In the example depicted in FIGS. 1-5, uplighting lighting source 40 is carried on the top of fixture housing 14 and has a diffuser or a plurality of LEDs disposed at about a forty-five degree angle to the vertical rear of fixture 10 to project light up and out away from fixture 10. This configuration is useful for lighting the spaces above the mounting location for fixture 10 and the ceiling of a tunnel which can be four to twelve feet above fixture 10. Light source 40 includes a plurality of LEDs that illuminate a ceiling at least 5.00 foot-candles during the task lighting mode of fixture 10. The uplighting can provide illumination in a range of 5.00 fc to 50.00 fc. The uplighting light source 40 is normally on by default when fixture 10 is switched to task lighting mode. An option allows uplighting lighting source 40 to be turned off during the task lighting mode.

Light fixtures 10 can be switched between the normal lighting mode and its task lighting mode with a switch, for example switch 50, carried by fixture 10 and manually operated by the user. Switch 50 can be a push button or a switch operated with a magnet that is brought into proximity to a location on fixture 10. Each activation of switch 50 changes the mode of operation for fixture 10. In one configuration, a timer is used to automatically switch the mode of fixture 10 back to the normal mode after a set amount of time such as ten minutes or four hours. Fixture 10 has a manual override with a switch (such as a magnetically-activated switch), so that someone walking down the track with magnetic wand can manually set light fixture 10 to a work mode to provide task lighting without going through a wireless network or remote computer. In this exemplary model, the manual override switch provides a four or eight hour default for work mode task lighting before an automatic revert to emergency/standard mode. Each light fixture 10 can be optionally turned on and off as well as being switched between modes through a remote signal delivered through a wired connection or a wireless communications protocol. Using a signal from a remote location allows an entire section of tunnel to be lit in for task lighting without the need to push a button on each fixture. Each light fixture or a plurality of fixtures can be controlled through a graphic user interface running a remote computer to supply the signals to the light fixtures 10. The graphic user interface allows one or a plurality of light fixtures 10 to be turned to task lighting mode for an hour or up to a period of weeks or months.

In work task lighting mode with task lighting being provided, light fixtures 10 include an option for an indicator light (which can be a yellow-colored light) either on the sides or front of fixture 10 to serve as a supplementary system to flagging to alert train conductors that work is occurring on the track for the conductor to drive slower.

Light fixtures 10 can be controlled by an authorized user, the manager of the facility, or by the authority having jurisdiction over the maintenance, from a remote computer. The signals can be delivered through an Ethernet cable, a Power Line Communication protocol, or a data wire directly from the remote computer or through the Internet. The signal also may be delivered through any of a variety of wireless communications protocols including a mesh network such as a 915 MHz mesh network, WIFI, ZigBee, or RuBee (IEEE standard 1902.1). In order to communicate the data, each fixture can include a communications device that provides for the desired communications. For example, each fixture can include a network repeater, a Wifi chip, a ZigBee chip, or a RuBee transceiver. The remote computer can be a computer located in the same facility as the light fixture providing the reporting or a computer located in a location remote from the facility.

Fixture housings 14 may be substantially hollow to contain a variety of components used with fixture 10. In one exemplary configuration, batteries and components of a self-testing battery backup system are carried within housing 14. One or more power supplies also may be carried within housing 14. In other configurations, the battery backup system and the power supply can be located in locations remote from housing 14. The remote location can be a few feet away or farther such as other locations within the building or facility.

Light fixtures 10 are configured to be supplied by one of three line power sources in addition to the backup battery power source. In public transportation facilities, electrical power is available from the main power line which is typically between 110V to 277V alternating current. A second source of between 110V to 277V alternating current is often provided from a secondary power source. A third high voltage source of electrical power greater than 277V is the high voltage "third rail" power source from which train engines drawn power. The third source can be between 450V-1000V direct current or commonly about 600V. The power supply or power supplies for the LED light engines includes power inputs for each of these three power sources such that any of the three sources can be connected or a combination of two or all of the sources can be connected to allow whichever source is available to supply the power. The power input connections can be provided with quick connect and quick disconnect power connectors to allow fixture 10 to be readily removed and replaced. A switch is used to allow the user to manually select a power supply or to cause the power supply to automatically switch over to an available power supply in the event of a failure of another. For example, if the light fixture is being powered by the 600 Volt power supply and there is a failure of that power source, the power supply recognizes the voltage drop and automatically switches to the first of the 110-277 Volt power sources. If the first is not available, the power supply looks for the second 110-277 Volt power source. If all three of these power sources are not available, the power supply switches over to battery backup power where available.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the above description and attached illustrations are an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. A light fixture for use in a train tunnel for track lighting; the light fixture comprising:

a first light source having normal downlighting mode and a task lighting mode; the first light source includes a first plurality of LEDs; the task lighting mode using the same first plurality of LEDs as the normal downlighting mode; the task lighting mode of the first light source outputting more lumens in the task lighting mode than when operating in the normal downlighting mode.

2. The light fixture of claim 1, further comprising a fixture housing having a top and a bottom; the first light source disposed to direct light from the bottom of the fixture housing.

3. The light fixture of claim 2, further comprising a second light source disposed to selectively direct light up from the top of the fixture housing; the second light source outputting more lumens than the first light source when the first light source is operating in the normal downlighting mode.

4. The light fixture of claim 2, wherein the fixture housing shades light from projecting laterally along the tunnel.

5. The light fixture of claim 1, further comprising a switch that changes the first light source between the normal downlighting mode and the task lighting mode.

6. The light fixture of claim 5, wherein the switch is magnetically activated.

7. The light fixture of claim 1, further comprising a timer that switches the first light source from the task lighting mode to the normal downlighting mode.

8. The light fixture of claim 1, wherein the first light source can be switched between the normal downlighting mode and the task lighting mode from a remote location.

9. A light fixture for use in a train tunnel for track lighting; the light fixture comprising:

a first light source having normal downlighting mode and a task lighting mode; the first light source includes a first plurality of LEDs; the task lighting mode using the same first plurality of LEDs as the normal downlighting mode; the task lighting mode of the first light source outputting more lumens in the task lighting mode than when operating in the normal downlighting mode;

a fixture housing having a top and a bottom; the first light source disposed to direct light from the bottom of the fixture housing;

a second light source disposed to selectively direct light up from the top of the fixture housing; the second light source outputting more lumens than the first light source when the first light source is operating in the normal downlighting mode; and the second light source is being activated when the first light source is switched to the task lighting mode.

10. An LED light fixture for providing pathway light for a train tunnel wherein the LED light fixture mountable to a surface to provide downwardly-directed light for the train track of a train tunnel; the LED light fixture comprising:

a first LED light engine that includes a first plurality of LEDs;

an LED power supply for selectively powering the first LED light engine in a normal downlighting mode and a task lighting mode; the task lighting mode using the same first plurality of LEDs as the normal downlighting mode;

the normal downlighting mode providing 0.25 to 2.00 foot candles of illumination on a horizontal surface disposed six to fourteen feet below the first LED light engine;

the task lighting mode providing at least 5.00 foot candles of illumination on the horizontal surface; and a light fixture housing that carries the first LED light engine and the LED power supply;

the light fixture housing having a bottom and carrying the first LED light engine within the light unit housing in a position to shine light down from the bottom of the light unit housing when the LED light fixture is mounted to the surface to provide track lighting.

11. The light fixture of claim 10, wherein the first LED light engine powers more LEDs in the task lighting mode than when in the normal downlighting mode.

12. The light fixture of claim 10, wherein the LEDs of the first LED light engine are powered at a higher current in the task lighting mode than when in the normal downlighting mode.

13. The light fixture of claim 10, further comprising a second LED light engine that provides 5.00 to 50.00 foot candle of illumination in an uplighting configuration to a surface four to twelve feet away from the second LED light engine when the light fixture is in the task lighting mode.

14. The light fixture of claim 10, further comprising a bracket for mounting the light unit housing to the surface.

15. The light fixture of claim 14, wherein the bracket includes an upwardly projecting flange; the fixture housing hanging on the upwardly projecting flange.

16. The light fixture of claim 15, wherein the fixture housing includes a hook the projects rearwardly from the fixture housing; the hook defining a hook opening the opens downwardly; the hook disposed over the upwardly projecting flange to support fixture housing on the mounting bracket.

17. The light fixture of claim 15, wherein the mounting bracket includes a main body that defines a rear surface of mounting bracket adapted to contact the structure upon which the mounting bracket is mounted; the upwardly projecting flange disposed forward of the rear surface.

18. The light fixture of claim 17, wherein the main body of the mounting bracket defines a front surface; the mounting bracket including an upper rail and a lower rail that both project forward from the front surface of main body to provide space between the fixture housing and the front surface of main body.

19. The light fixture of claim 18, further comprising a lower flange projecting down from the lower rail; the lower flange defining a fastener channel adapted to receive fasteners that secure the fixture housing to the mounting bracket.

20. The light fixture of claim 14, wherein the fixture housing is selectively pivotable mounted to the mounting bracket.

* * * * *